US008589051B2

(12) United States Patent
Kuwahara et al.

(10) Patent No.: US 8,589,051 B2
(45) Date of Patent: Nov. 19, 2013

(54) CONTROLLER FOR ENGINE

(75) Inventors: Seiji Kuwahara, Toyota (JP); Masato Kaigawa, Toyota (JP); Toshiya Oishi, Toyota (JP); Shogo Matsumoto, Toyota (JP)

(73) Assignee: Toyota Jidosha Kabushiki Kaisha, Toyata (JP)

( * ) Notice: Subject to any disclaimer, the term of this patent is extended or adjusted under 35 U.S.C. 154(b) by 705 days.

(21) Appl. No.: 12/738,166

(22) PCT Filed: Dec. 23, 2008

(86) PCT No.: PCT/IB2008/003595

§ 371 (c)(1),
(2), (4) Date: Apr. 15, 2010

(87) PCT Pub. No.: WO2009/083776

PCT Pub. Date: Jul. 9, 2009

(65) Prior Publication Data

US 2010/0262352 A1 Oct. 14, 2010

(30) Foreign Application Priority Data

Dec. 28, 2007 (JP) ..... 2007-339528

(51) Int. Cl.

| | |
|---|---|
| ***G06F 19/00*** | (2011.01) |
| ***G06G 7/70*** | (2006.01) |
| ***F02D 13/00*** | (2006.01) |
| ***F02D 11/10*** | (2006.01) |
| ***F02D 9/08*** | (2006.01) |
| ***F16H 61/48*** | (2006.01) |

(52) U.S. Cl.
USPC ..... 701/102; 123/347; 123/396; 123/403; 477/54; 477/61

(58) Field of Classification Search
USPC ..... 123/347–352, 357, 361, 395, 396, 399, 123/403; 701/54, 102, 103, 106, 110, 115
See application file for complete search history.

(56) References Cited

U.S. PATENT DOCUMENTS 2,231,621 A * 2/1941 Goodridge ..... 250/208.4
6,415,218 B2 * 7/2002 Shimada et al. ..... 701/103

(Continued)

FOREIGN PATENT DOCUMENTS

DE 100 07 136 A1 9/2000
EP 1 279 814 A2 1/2003

(Continued)

OTHER PUBLICATIONS

International Search Report issued in corresponding International Application No. PCT/IB2008/003595, mailed Jul. 14, 2009.

(Continued)

*Primary Examiner* — Stephen K Cronin
*Assistant Examiner* — Sherman Manley
(74) *Attorney, Agent, or Firm* — Oliff & Berridge, PLC

(57) ABSTRACT

An ECU includes: an engine control unit that controls devices provided for an engine on the basis of a target engine rotational speed; and an engine model that calculates the target engine rotational speed such that the target engine rotational speed varies in accordance with a target engine torque and an actual engine rotational speed in a steady state, and that calculates the target engine rotational speed such that the target engine rotational speed varies in accordance with the target engine torque independently of the actual engine rotational speed in a transient state in which the engine is unstable as compared with the steady state. When the engine is controlled by the thus configured ECU, the control accuracy is improved.

11 Claims, 7 Drawing Sheets

(56) References Cited

U.S. PATENT DOCUMENTS

| | | | | |
|---|---|---|---|---|
| 6,434,472 | B1 * | 8/2002 | Minowa et al. | 701/96 |
| 6,440,037 | B2 * | 8/2002 | Takagi et al. | 477/37 |
| 6,513,489 | B2 * | 2/2003 | Osanai | 123/339.11 |
| 6,574,541 | B2 * | 6/2003 | Katakura et al. | 701/54 |
| 7,295,915 | B1 * | 11/2007 | Okubo et al. | 701/110 |
| 7,509,200 | B2 * | 3/2009 | Ito et al. | 701/51 |
| 2002/0050269 | A1 * | 5/2002 | Osanai | 123/339.11 |
| 2005/0130800 | A1 | 6/2005 | Rieger et al. | |
| 2006/0293149 | A1 | 12/2006 | Landes | |
| 2009/0024288 | A1 * | 1/2009 | Kuwahara et al. | 701/54 |
| 2010/0262352 | A1 * | 10/2010 | Kuwahara et al. | 701/102 |

FOREIGN PATENT DOCUMENTS

| | | |
|---|---|---|
| JP | A 10-325348 | 12/1998 |
| JP | A 2007-132203 | 5/2007 |

OTHER PUBLICATIONS

Written Opinion of the International Searching Authority issued in corresponding International Application No. PCT/IB2008/003595, mailed Jul. 14, 2009.

Japanese Office Action issued in corresponding Japanese Application No. 2007-339528, dispatched Dec. 1, 2009. (with partial English-language translation).

* cited by examiner

FIG. 3

| | C1 | C2 | C3 | C4 | B1 | B2 | F |
|---|---|---|---|---|---|---|---|
| P | × | × | × | × | × | × | × |
| R1 | × | × | ○ | × | × | ○ | × |
| R2 | × | × | × | ○ | × | ○ | × |
| N | × | × | × | × | × | × | × |
| 1ST | ○ | × | × | × | × | ◎ | △ |
| 2ND | ○ | × | × | × | ○ | × | × |
| 3RD | ○ | × | ○ | × | × | × | × |
| 4TH | ○ | × | × | ○ | × | × | × |
| 5TH | ○ | ○ | × | × | × | × | × |
| 6TH | × | ○ | × | ○ | × | × | × |
| 7TH | × | ○ | ○ | × | × | × | × |
| 8TH | × | ○ | × | × | ○ | × | × |

○: ENGAGED
×: RELEASED
◎: ENGAGED DURING ENGINE BRAKING
△: ENGAGED ONLY DURING DRIVING

CONTROLLER FOR ENGINE

INCORPORATION BY REFERENCE

The disclosure of Japanese Patent Application No. 2007-339528 filed on Dec. 28, 2007, including the specification, drawings and abstract is incorporated herein by reference in its entirety.

BACKGROUND OF THE INVENTION

1. Field of the Invention

The invention relates to a controller for an engine and, more particularly, to a technology for controlling an engine utilizing a target engine rotational speed.

2. Description of the Related Art

In a known existing engine, an output power is determined on the basis of a throttle opening degree. In general, a throttle opening degree is in one-to-one correspondence with an accelerator operation amount. However, when the throttle opening degree is always in one-to-one correspondence with the accelerator operation amount, if the behavior of a vehicle, for example, becomes unstable, it is difficult to control a driving force, and the like, of the vehicle irrespective of driver's intention. Then, to make it possible to control an output power independently of the accelerator operation amount, some vehicles are equipped with an electronic throttle valve that is actuated by an actuator. In a vehicle equipped with the electronic throttle valve, it is possible to set a target engine torque on the basis of a behavior of the vehicle, and the like, in addition to, the accelerator operation amount and control an engine so that an actual engine torque becomes the target engine torque.

Japanese Patent Application Publication No. 2007-132203 (JP-A-2007-132203) describes a controller that controls devices of an internal combustion engine on the basis of a set target torque. The controller described in JP-A-2007-132203 includes an estimation unit that estimates a torque the internal combustion engine generates; a difference calculation unit that calculates a difference between the estimated torque calculated by the estimation unit and the target torque; a control amount calculation unit that calculates a torque control amount that compensates for response delay on the basis of the difference calculated by the difference calculation unit; and a control unit that generates command values to the devices on the basis of the torque control amount calculated by the control amount calculation unit to control the devices. The estimation unit estimates a torque using a model formula that is formed to include the response delay of the internal combustion engine. The control amount calculation unit adds a value, which is calculated using a difference calculated by the difference calculation unit and a coefficient, to the target torque to obtain the torque control amount. The coefficient is changed on the basis of the rotational speed and intake air amount of the internal combustion engine.

According to the controller described in JP-A-2007-132203, in order to achieve the target torque, the torque control amount for controlling the devices of the internal combustion engine is calculated on the basis of the difference between the estimated torque and the target torque and is compensated for response delay. Thus, the above controller compensates for response delay of the internal combustion engine, so it is possible to eliminate the response delay to improve the response of control.

Incidentally, to control the engine so as to achieve the target engine torque, it needs an engine rotational speed corresponding to the target engine torque. For example, in order to set an exhaust gas recirculation (EGR) amount, and the like, to achieve the target engine torque, it is necessary to calculate a load on the basis of an actual intake air amount of the engine and a maximum air amount the engine can take in. Then, in order to calculate the maximum air amount that the engine can take in, an engine rotational speed is necessary. However, an actual engine rotational speed corresponds to the actual engine torque, and the actual engine torque is achieved behind the target engine torque. Thus, the actual engine rotational speed detected at the time when the target engine torque is set differs from the engine rotational speed at the time when the target engine torque is achieved. For this reason, when the engine is controlled using the actual engine rotational speed together with the target engine torque, control accuracy of the engine may deteriorate. However, in the controller described in JP-A-2007-132203, the torque control amount for controlling the devices is calculated using an actual rotational speed of the internal combustion engine. Thus, there is still room for improvement in control accuracy of the engine.

SUMMARY OF THE INVENTION

The invention provides a controller for an engine, which is able to improve the control accuracy of the engine.

An aspect of the invention provides a controller for an engine that is mounted on a vehicle. The controller includes: a target engine torque setting unit that sets a target engine torque; an actual engine rotational speed detection unit that detects an actual engine rotational speed; a calculation unit that calculates a target engine rotational speed such that the target engine rotational speed varies in accordance with the target engine torque and the actual engine rotational speed in a first operational state, and that calculates the target engine rotational speed such that the target engine rotational speed varies in according with the target engine torque independently of the actual engine rotational speed in a second operational state in which the engine, is unstable as compared with the first operational state; and a control unit that controls the engine using the target engine rotational speed.

With the above configuration, a target engine rotational speed is calculated such that the target engine rotational speed varies in accordance with a target engine torque and an actual engine rotational speed in, the first, operational state. On the other hand, in the second operational state in which, because of an unstable engine, a difference between an actual engine rotational speed detected at the time when a target engine torque is set and an engine rotational speed, at which the target engine torque is achieved, can be large, a target engine rotational speed is calculated so that the target engine rotational speed varies in accordance with the target engine torque independently of the actual engine rotational speed. The engine is controlled using the target engine rotational speed. By so doing, in the first operational state in which a difference between the actual engine rotational speed and the engine rotational speed, at which the target engine torque is achieved, is smaller than that of the second operational state, for example, the target engine rotational speed calculated from the target engine torque may be corrected using the actual engine rotational speed and then the engine may be controlled using the corrected target engine rotational speed. In the second operational state in which the engine is unstable, it is possible to obtain the target engine rotational speed that varies only in accordance with the target engine torque independently of the actual engine rotational speed. Thus, it is possible to control the engine using the target engine rotational speed that accurately corresponds to the engine rotational speed at which the target engine torque is achieved. As a result, it is possible to provide a controller for an engine, which is able to improve the control accuracy of the engine.

In addition, in the controller, the calculation unit may calculate the target engine rotational speed on the basis of the target engine torque, and the calculation unit may set a correction value, by which the target engine rotational speed is corrected, in accordance with the actual engine rotational speed in the first operational state.

With the above configuration, the target engine rotational speed calculated on the basis of the target engine torque is corrected using a correction value that is set in accordance with the actual engine rotational speed in the first operational state. Thus, the target engine rotational speed is calculated such that the target engine rotational speed varies in accordance with the target engine torque and the actual engine rotational speed in the first operational state. On the other hand; the target engine rotational speed is calculated such that the target engine rotational speed varies in accordance with the target engine torque independently of the actual engine rotational speed in the second operational state. By so doing, it is possible to accurately obtain the target engine rotational speed at which the target engine torque is achieved.

In addition, in the controller, the engine may be coupled through a torque converter to a transmission, and the controller may further include a first rotational speed calculation unit that calculates a target turbine rotational speed of the torque converter on the basis of the target engine torque. Then, the calculation unit may include a second rotational speed calculation unit that calculates the target engine rotational speed such that the target engine rotational speed varies in accordance with the target turbine rotational speed and the actual engine rotational speed in the first operational state, and that calculates the target engine rotational speed such that the target engine rotational speed varies in accordance with the target turbine rotational speed independently of the actual engine rotational speed in the second operational state.

With the above configuration, a target engine rotational speed is calculated using the target turbine rotational speed of the torque converter, which can influence the engine rotational speed. By so doing, it is possible to accurately calculate the target engine rotational speed.

In addition, in the controller, the first rotational speed calculation unit may include a turbine torque calculation unit that calculates a target turbine torque of the torque converter on the basis of the target engine torque and a torque ratio of the torque converter; a target driving force calculation unit that calculates a target driving force of the vehicle on the basis of the target turbine torque; a target acceleration calculation unit that calculates a target acceleration of the vehicle on the basis of the target driving force; a target vehicle speed calculation unit that calculates a target vehicle speed on the basis of the target acceleration; and a target turbine rotational speed calculation unit that calculates the target turbine rotational speed on the basis of the target vehicle speed and a gear ratio of the transmission.

With the above configuration, a target turbine torque is calculated on the basis of the target engine torque and the torque ratio. A target driving force is calculated on the basis of the target turbine torque. A target acceleration is calculated on the basis of the target driving force. A target vehicle speed is calculated on the basis of the target acceleration. For example, when the transmission is in a state in which a torque can be transmitted, a target turbine rotational speed, that is, an input shaft rotational speed of the transmission, depends on an output shaft rotational speed, that is, a vehicle speed. Thus, a target turbine rotational speed is calculated on the basis of the target vehicle speed. By so doing, it is possible to accurately calculate the target turbine rotational speed.

In addition, in the controller, the turbine torque calculation unit may calculate the target turbine torque by subtracting a torque, caused by an inertia of the transmission, from the product of the target engine torque and a torque ratio of the torque converter.

With the above configuration, because a torque that can be used to drive the vehicle is reduced due to resistance of the transmission itself, a target turbine torque, that is, an input torque of the transmission, is calculated by subtracting a torque, caused by the inertia of the transmission, from the product of the target engine torque and the torque ratio of the torque converter. By so doing, it is possible to accurately calculate the driving force of the vehicle.

In addition, the controller may further include an actual vehicle speed detection unit that detects an actual vehicle speed; and a target vehicle speed correction value setting unit that sets a correction value, by which the target vehicle speed is corrected, in accordance with the actual vehicle speed in the first operational state.

With the above configuration, a correction value, by which the target vehicle speed is corrected, is set in accordance with the actual vehicle speed in the first operational state in which the vehicle is stable. By so doing, it is possible to reduce a potential error when a target vehicle speed is calculated. Thus, it is possible to accurately calculate the target vehicle speed.

In addition, in the controller, the first rotational speed calculation unit may calculate a target turbine angular acceleration of the torque converter on the basis of the target engine torque and an inertia of the transmission, and the first rotational speed calculation unit may calculate a target turbine rotational speed of the torque converter on the basis of the target turbine angular acceleration.

With the above configuration, for example, when the transmission is neutral, the turbine rotational speed depends on the target engine torque and the inertia of the transmission. Thus, a target turbine angular acceleration is calculated on the basis of the target engine torque and the inertia of the transmission, and a target turbine rotational speed is calculated on the basis of the target turbine angular acceleration. By so doing, it is possible to accurately calculate the target turbine rotational speed.

In addition, the controller may further include an actual turbine rotational speed detection unit that detects an actual turbine rotational speed; and a target turbine rotational speed correction value setting unit that sets a correction value, by which the target turbine rotational speed is corrected, in accordance with the actual turbine rotational speed in the first operational state.

With the above configuration, a correction value, by which the target turbine rotational speed is corrected, is set in accordance with the actual turbine rotational speed in the first operational state in which the vehicle is stable. By so doing, it is possible to reduce a potential error when a target turbine rotational speed is calculated. Thus, it is possible to accurately calculate the target turbine rotational speed.

In addition, in the controller, the second rotational speed calculation unit may include an engine rotational speed calculation unit that calculates the target engine rotational speed on the basis of the target turbine rotational speed; and a target engine rotational speed correction value setting unit that sets a correction value, by which the target engine rotational speed is corrected, in accordance with the actual engine rotational speed in the first operational state.

With the above configuration, the target engine rotational speed calculated on the basis of the target turbine rotational speed is corrected using the correction value that is set in accordance with the actual engine rotational speed in the first operational state. Thus, a target engine rotational speed is calculated such that the target engine rotational speed varies in accordance with the target turbine rotational speed and the actual engine rotational speed in the first operational state. On the other hand, the target engine rotational speed is calculated such that the target engine rotational speed varies in accordance with the target turbine rotational speed independently of the actual engine rotational speed in the second operational state. By so doing, it is possible to accurately obtain the target engine rotational speed at which the target engine torque is achieved.

In addition, in the controller, the engine rotational speed calculation unit may calculate the target engine rotational speed in accordance with a map that has the target engine torque and the target turbine rotational speed as parameters.

With the above configuration, a target engine rotational speed is calculated, in accordance with the map that has the target engine torque and the target turbine rotational speed as parameters. By so doing, it is possible to accurately calculate the target engine rotational speed in accordance with the map that is empirically prepared beforehand.

In addition, in the controller, the torque converter may be provided with a lock-up clutch, the engine rotational speed calculation unit may calculate the target engine rotational speed in accordance with a map that has the target engine torque and the target turbine rotational speed as parameters when the lock-up clutch is released, the engine rotational speed calculation unit may calculate the target turbine rotational speed as the target engine rotational speed when the lock-up clutch is engaged, the engine rotational speed calculation unit may calculate a rotational speed that is greater by a predetermined value than the target turbine rotational speed as the target engine rotational speed when the lock-up clutch is slipped, and the target engine rotational speed correction, value setting unit may set a correction value, by which the target engine rotational speed calculated in accordance with the map is corrected, in accordance with the actual engine rotational speed when the lock-up clutch is released in the first operational state.

With the above configuration, when the lock-up clutch is engaged, the input shaft and output shaft of the torque converter rotate integrally. Thus, a target turbine rotational speed is calculated as the target engine rotational speed. When the lock-up clutch is slipped, a difference in rotational speed between the input shaft and output shaft of the torque converter is maintained substantially at constant. Thus, a rotational speed that is greater by a predetermined value than the target turbine rotational speed is calculated as the target engine rotational speed. When the lock-up clutch is released, the target engine rotational speed calculated in accordance with the map that has the target engine torque and the target turbine rotational speed as parameters is corrected using the correction value that is set in accordance with the actual engine rotational speed in the first operational state. Thus, a target engine rotational speed is calculated so that the target engine rotational speed varies in accordance with the target turbine rotational speed and the actual engine rotational speed in the first operational state, while a target engine rotational speed is calculated so that the target engine rotational speed varies in accordance with the turbine rotational speed independently of the actual engine rotational speed in the second operational state. By so doing, in consideration of the transmission characteristics of the torque converter, it is possible to accurately obtain the target engine rotational speed at which target engine torque is achieved.

In addition, in the controller, the target engine torque may be obtained by subtracting a torque, caused by an inertia of the engine, from a target torque that the engine generates.

With the above configuration, a torque that can be effectively used to change an engine rotational speed, and the like, within a torque that the engine generates is reduced due to resistance of the engine itself. Thus, a torque that is obtained by subtracting the torque, caused by the inertia of the engine, from the target torque that the engine generates is used as the target engine torque. By so doing, it is possible to accurately calculate the target engine rotational speed.

Furthermore, the controller may further include an actual engine torque detection unit that detects an actual engine torque; and a target engine torque correction value setting unit that sets a correction value, by which the target engine torque is corrected, in accordance with the actual engine torque in the first operational state.

With the above configuration, a correction value, by which the target engine torque is corrected, is set in accordance with the actual engine torque in the first operational state in which the vehicle is stable. By so doing, it is possible to reduce a potential error when a target engine torque is calculated. Hence, it is possible to accurately obtain the target engine torque.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein:

FIG. 3 is an operation table of the automatic transmission;

DETAILED DESCRIPTION OF EMBODIMENTS

Figure 1:
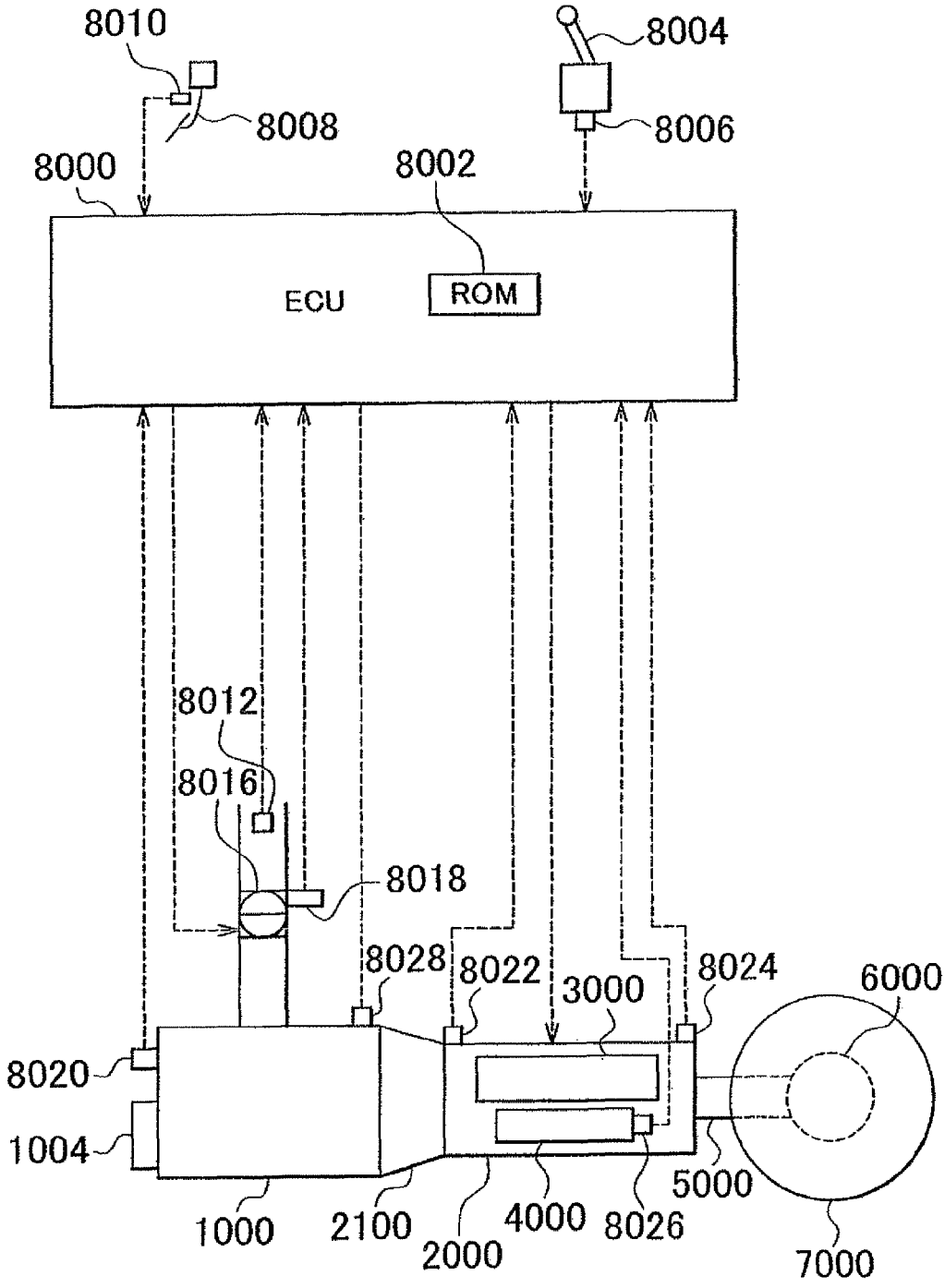
FIG. 1 is a schematic configuration diagram that shows a vehicle power train to which a controller for an engine according to an embodiment of the invention is applied.

Hereinafter, an embodiment of the invention will be described with reference to the accompanying drawings. In the following description, like reference numerals denote like components. The names and functions of those components are the same. Thus, the detailed description thereof will not be repeated.

Referring, to FIG. 1, a vehicle equipped with a controller according to the embodiment of the invention will be described. This vehicle is a front-engine rear-wheel-drive (FR) vehicle. Note that the vehicle may be other than the FR vehicle.

The vehicle includes an engine 1000, an automatic transmission 2000, a torque converter 2100, a planetary gear unit 3000 that constitutes portion of the automatic transmission 2000, a hydraulic circuit 4000 that constitutes portion of the automatic transmission 2000, a propeller shaft 5000, a differential gear 6000, rear wheels 7000, and an electronic control unit (ECU) 8000.

The engine 1000 is an internal combustion engine that burns an air fuel mixture, which is injected from an injector (not shown), in a combustion chamber of a cylinder. As the air fuel mixture burns, a piston in the cylinder is pushed downward to thereby rotate a crankshaft. Driving force of the engine 1000 drives an auxiliary machine 1004, such as an alternator and an air conditioner. Note that a motor may be used as a driving source in place of or in addition to the engine 1000.

The automatic transmission 2000 is coupled to the engine 1000 through the torque converter 2100. The automatic transmission 2000 establishes a desired gear to change the rotational speed of the crankshaft to a desired rotational speed, and transmits power from the engine 1000 to the propeller shaft 5000. Note that in place of the automatic transmission that establishes a gear, the vehicle may be equipped with a continuously variable transmission (CVT) that steplessly changes a gear ratio. Furthermore, the vehicle may be equipped with a constant-mesh-gear automatic transmission of which the gear is shifted by a hydraulic actuator or an electric motor.

Driving force output from the automatic transmission 2000 is transmitted through the propeller shaft 5000 and the differential gear 6000 to the right and left rear wheels 7000.

The ECU 8000 is connected to a position switch 8006 of a shift lever 8004, an accelerator operation amount sensor 8010 of an accelerator pedal 8008, an air flow meter 8012, a throttle opening degree sensor 8018 of an electronic throttle valve 8016, an engine rotational speed sensor 8020, an input shaft rotational speed sensor 8022, an output shaft rotational speed sensor 8024, an oil temperature sensor 8026, and a coolant temperature sensor 8028 through a harness, and the like.

The position switch 8006 detects the position of the shift lever 8004 and transmits a signal that indicates the detected position to the ECU 8000. The automatic transmission 2000 automatically establishes the gear in correspondence with the position of the shift lever 8004. In addition, the automatic transmission 2000 may be configured so that the driver may select a manual shift mode. In the manual shift mode, the driver may select any gear in response to driver's operation.

The accelerator operation amount sensor 8010 detects the operation amount of the accelerator pedal 8008 and transmits a signal that indicates the detected operation amount to the ECU 8000. The air flow meter 8012 detects the amount of air taken into the engine 1000 (intake air amount) and transmits a signal that indicates the detected intake air amount to the ECU 8000.

The throttle opening degree sensor 8018 detects the opening degree of the electronic throttle valve 8016 and transmits a signal that indicates the detected opening degree to the ECU 8000. The opening degree of the electronic throttle valve 8016 is adjusted by an actuator. The electronic throttle valve 8016 adjusts the amount of air taken into the engine 1000 (output power of the engine 1000).

Note that in place of or in addition to the electronic throttle valve 8016, the lift amount and/or opening/closing phase of an intake valve (not shown) and/or an exhaust valve (not shown) may be varied to adjust the amount of air taken into the engine 1000.

The engine rotational speed sensor 8020 detects the rotational speed of an output shaft (crankshaft) of the engine 1000 (hereinafter, also referred to as engine rotational speed NE), and transmits a signal that indicates the detected engine rotational speed NE to the ECU 8000. The input shaft rotational speed sensor 8022 detects an input shaft rotational speed NI of the automatic transmission 2000 (turbine rotational speed NT of the torque converter 2100), and transmits a signal that indicates the detected input shaft rotational speed NI to the ECU 8000. The output shaft rotational speed sensor 8024 detects an output shaft rotational speed NO of the automatic transmission 2000, and transmits a signal that indicates the detected output shaft rotational speed NO to the ECU 8000.

The oil temperature sensor 8026 detects the temperature (oil temperature) of an oil (automatic transmission fluid: ATF) used for operation and lubrication of the automatic transmission 2000, and transmits a signal that indicates the detected oil temperature to the ECU 8000.

The coolant temperature sensor 8028 detects the coolant temperature of the engine 1000, and transmits a signal that indicates the detected coolant temperature to the ECU 8000.

The ECU 8000 controls devices so that the vehicle performs a desired running state on the basis of the signals transmitted from the position switch 8006, the accelerator operation amount sensor 8010, the air flow meter 8012, the throttle opening degree sensor 8018, the engine rotational speed sensor 8020, the input shaft rotational speed sensor 8022, the output shaft rotational speed sensor 8024, the oil temperature sensor 8026, the coolant temperature sensor 8028, and the like, maps and programs stored in a read only memory (ROM) 8002. Note that programs executed by the ECU 8000 may be recorded in a recording medium, such as a compact disc (CD) or a digital versatile disc (DVD), and may be commercially distributed.

In the present embodiment, when the shift lever 8004 is in the D (drive) position and the D (drive) range is selected as the shift range of the automatic transmission 2000, the automatic transmission 2000 is controlled to establish any one of the gears among the forward first to eighth gears. When any one of the gears among the forward first to eighth gears is established, the automatic transmission 2000 is able to transmit driving force to the rear wheels 7000. Note that the D range may be configured to establish a gear that is higher than the eighth gear. A current gear is determined on the basis of a shift line map that is empirically prepared beforehand and that has a vehicle speed and an accelerator operation amount as parameters. Note that the ECU may be divided into a plurality of ECUs.

Figure 2:
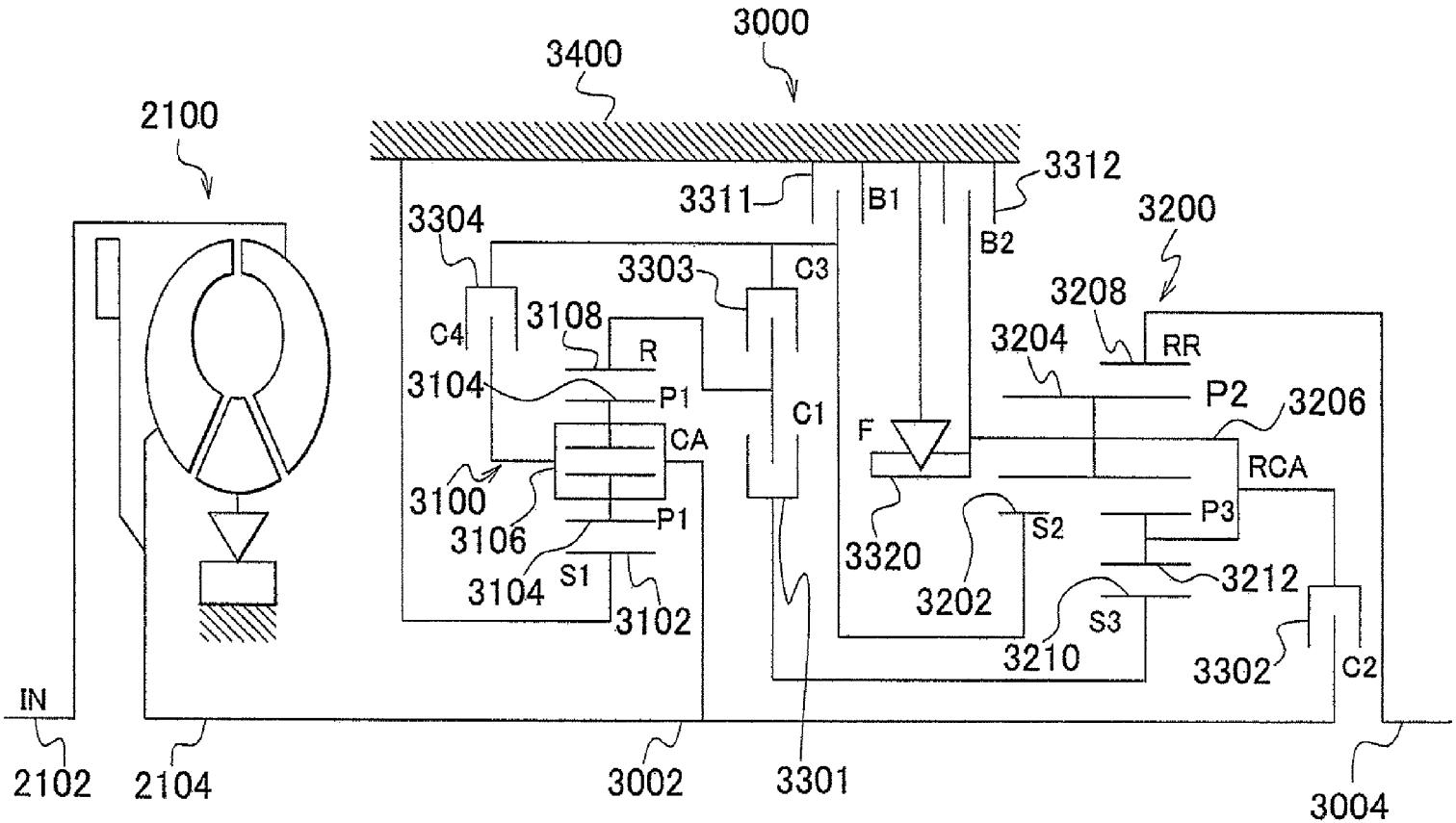
FIG. 2 is a skeleton view that shows a planetary gear unit of an automatic transmission that constitutes portion of the power train.

The planetary gear unit 3000 will be described with reference to FIG. 2. The planetary gear unit 3000 is connected to the torque converter 2100 that has an input shaft 2102 coupled to the crankshaft.

The planetary gear unit 3000 includes a front planetary gear 3100, a rear planetary gear 3200, a C1 clutch 3301, a C2 clutch 3302, a C3 clutch 3303, a C4 clutch 3304, a E1 brake 3311, a B2 brake 3312, and a one-way clutch (F) 3320.

The front planetary gear 3100 is a double-pinion planetary gear mechanism. The front planetary gear 3100 includes a first sun gear (S1) 3102, a pair of first pinion gears (P1) 3104, a carrier (CA) 3106, and a ring gear (R) 3108.

The first pinion gears (P1) 3104 are in mesh with the first sun gear (S1) 3102 and the first ring gear (R) 3108. The first carrier (CA) 3406 revolvably and rotatably supports the first pinion gear (P1) 3104.

The first sun gear (S1) 3102 is fixed to a gear case 3400 so that it is not rotatable. The first carrier (CA) 3106 is coupled to an input shaft 3002 of the planetary gear unit 3000.

The rear planetary gear 3200 is a Ravigneaux planetary gear mechanism. The rear planetary gear 3200 includes a second sun gear (S2) 3202, a second pinion gear (P2) 3204, a rear carrier (RCA) 3206, a rear ring gear (RR) 3208, a third sun gear (S3) 3210, and a third pinion gear (P3) 3212.

The second pinion gear (P2) 3204 is in mesh with the second sun gear (S2) 3202, the rear ring gear (RR) 3208 and the third pinion gear (P3) 3212. The third pinion gear (P3) 3212 is not only in mesh with the second pinion gear (P2) 3204 but also in mesh with the third sun gear (S3) 3210.

The rear carrier (RCA) 3206 revolvably and rotatably supports the second pinion gear (P2) 3204 and the third pinion gear (P3) 3212. The rear carrier (RCA) 3206 is coupled to the one-way clutch (F) 3320. The rear carrier (RCA) 3206 is not rotatable when the vehicle is driven in the first gear (when the vehicle is running with the driving force output from the engine 1000). The rear ring gear (RR) 3208 is coupled to an output shaft 3004 of the planetary gear unit 3000.

The one-way clutch (F) 3320 is provided in parallel with the B2 brake 3312. That is, an outer race of the one-way clutch (F) 3320 is fixed to the gear case 3400, and an inner race of the one-way clutch (F) 3320 is coupled to the rear carrier (RCA) 3206.

FIG. 3 is an operation table that shows the relationship between each gear and the operation states of the clutches and brakes. The brakes and the clutches are operated in accordance with combinations shown in the operation table to thereby establish the forward first to eighth gears, and reverse first and second gears.

A relevant portion of the hydraulic circuit 4000 will be described with reference to FIG. 4. Note that the hydraulic circuit 4000 is not limited to the one described below.

The hydraulic circuit 4000 includes an oil pump 4004, a primary regulator valve 4006, a manual valve 4100, a solenoid modulator valve 4200, an SL1 linear solenoid (hereinafter, referred to as SL(1)) 4210, an SL2 linear solenoid (hereinafter, referred to as SL(2)) 4220, an SL3 linear solenoid (hereinafter, referred to as SL(3)) 4230, an SL4 linear solenoid (hereinafter, referred to as SL(4)) 4240, an SL5 linear solenoid (hereinafter, referred to as SL(5)) 4250, an SLT linear solenoid (hereinafter, referred to as SLT) 4300, and a B2 control valve 4500.

The oil pump 4004 is coupled to the crankshaft of the engine 1000. As the crankshaft rotates, the oil pump 4004 is driven to generate hydraulic pressure. The hydraulic pressure generated by the oil pump 4004 is regulated by the primary regulator valve 4006 to generate a line pressure.

The primary regulator valve 4006 operates using a throttle pressure regulated, by the SLT 4300 as a pilot pressure. The line pressure is supplied through a line pressure oil passage 4010 to the manual valve 4100.

The manual valve 4100 has a drain port 4105. A hydraulic pressure in a D range pressure oil passage 4102 and a hydraulic pressure in an R range pressure oil passage 4104 are drained from the drain port 4105. When a spool of the manual valve 4100 is located at a D position, the line pressure oil passage 4010 communicates with the D range pressure oil passage 4102. Then, hydraulic pressure is supplied to the D range pressure oil passage 4102. At this time, the R range pressure, oil passage 4104 communicates with the drain port 4105, and an R range pressure of the R range pressure oil passage 4104 is drained from the drain port 4105.

When the spool of the manual valve 4100 is located at an R position, the line pressure oil passage 4010 communicates with the R range pressure oil passage 4104. Then, hydraulic pressure is supplied to the R range pressure oil passage 4104. At this time, the D range pressure oil passage 4102 communicates with the drain port 4105, and the D range pressure of the D range pressure oil passage 4102 is drained from the drain port 4105.

When the spool of the manual valve 4100 is located at an N position, both the D range pressure oil passage 4102 and the R range pressure oil passage 4104 communicate with the drain port 4105. Then, the D range pressure of the D range pressure oil passage 4102 and the R range pressure of the R range pressure oil passage 4104 are drained from the drain port 4105.

The hydraulic pressure supplied to the D range pressure oil passage 4102 is finally supplied to the C1 clutch 3301, the C2 clutch 3302 and the C3 clutch 3303. The hydraulic pressure supplied to the R range pressure oil passage 4104 is finally supplied to the B2 brake 3312.

The solenoid modulator valve 4200 uses the line pressure as a source pressure to regulate hydraulic pressure (solenoid modulator pressure) supplied to the SLT 4300 to a predetermined pressure.

The SL(1) 4210 regulates hydraulic pressure supplied to the C1 clutch 3301. The SL(2) 4220 regulates hydraulic pressure supplied to the C2 clutch 3302. The SL(3) 4230 regulates hydraulic pressure supplied to the C3 clutch 3303. The SL(4) 4240 regulates hydraulic pressure supplied to the C4 clutch 3304. The SL(5) 4250 regulates hydraulic pressure supplied to the B1 brake 3311.

The SLT 4300 regulates the solenoid modulator pressure to generate a throttle pressure in accordance with a control signal from the ECU 8000. The control signal is based on the accelerator operation amount detected by the accelerator operation amount sensor 8010. The throttle pressure is supplied through an SLT oil passage 4302 to the primary regulator valve 4006. The throttle pressure is utilized as the pilot pressure of the primary regulator valve 4006.

The SL(1) 4210, the SL(2) 4220, the SL(3) 4230, the SL(4) 4240, the SL(5) 4250 and the SLT 4300 are controlled by control signals transmitted from the ECU 8000.

The B2 control valve 4500 selectively supplies hydraulic pressure from any one of the D range pressure oil passage 4102 and the R range pressure oil passage 4104 to the B2 brake 3312. The B2 control valve 4500 is connected with the D range pressure oil passage 4102 and the R range pressure oil passage 4104. The B2 control valve 4500 is controlled by hydraulic pressure, supplied from an SLU solenoid valve (not shown), and an urging force of a spring.

Figure 4:
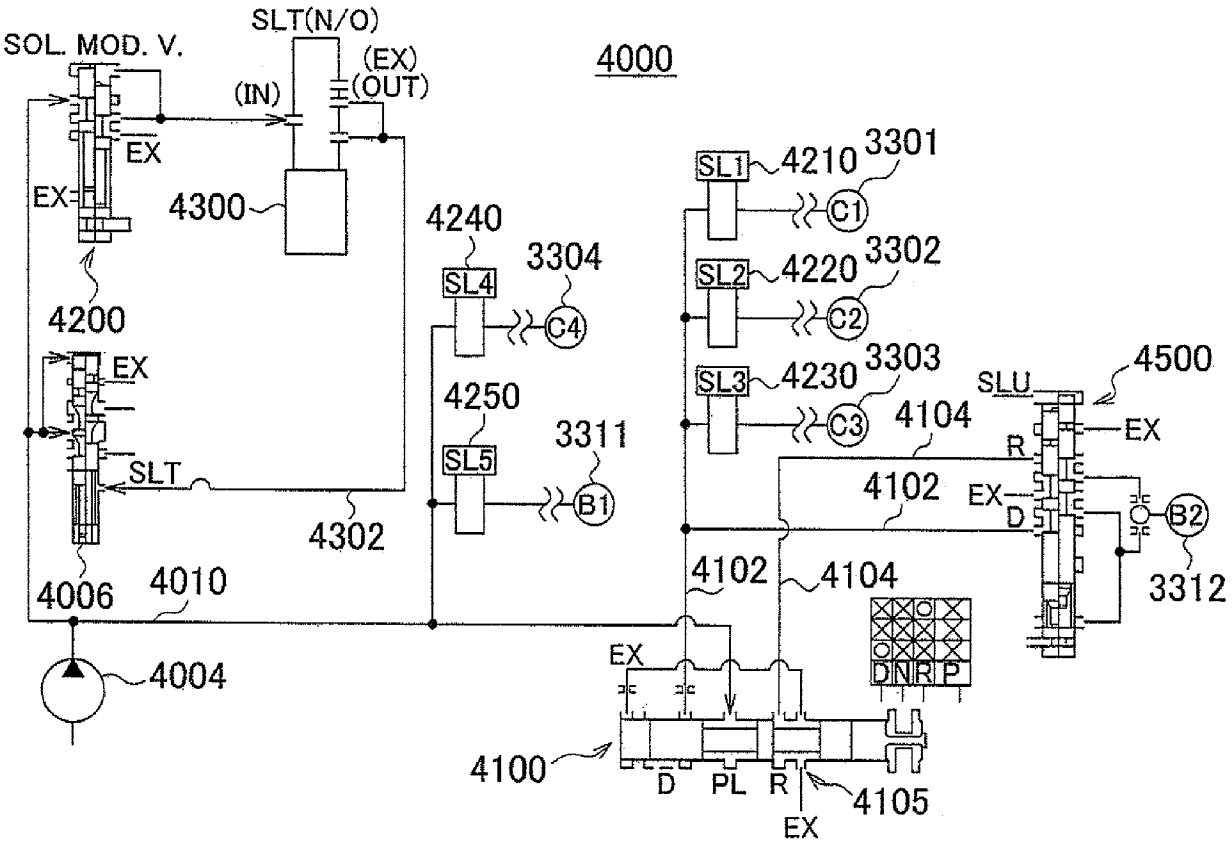
FIG. 4 is a view that shows a hydraulic circuit of the automatic transmission.

When the SLU solenoid valve is turned on, the B2 control valve 4500 is in a state shown at the left side thereof in FIG. 4. In this case, the B2 brake 3312 is supplied with hydraulic pressure that is regulated from the D range pressure using the hydraulic pressure supplied from the SLU solenoid valve as a pilot pressure.

When the SLU solenoid valve is turned off, the B2 control valve 4500 is in a state at the right side thereof in FIG. 4. In this case, the B2 brake 3312 is supplied with the R range pressure.

The ECU 8000 will be further described with reference to FIG. 5 and FIG. 6. Note that the functions of the ECU 8000 described below may be implemented by hardware or may be implemented by software. Note that the ECU 8000 repeatedly executes a process at predetermined time intervals so as to implement the functions described below.

Figure 5:
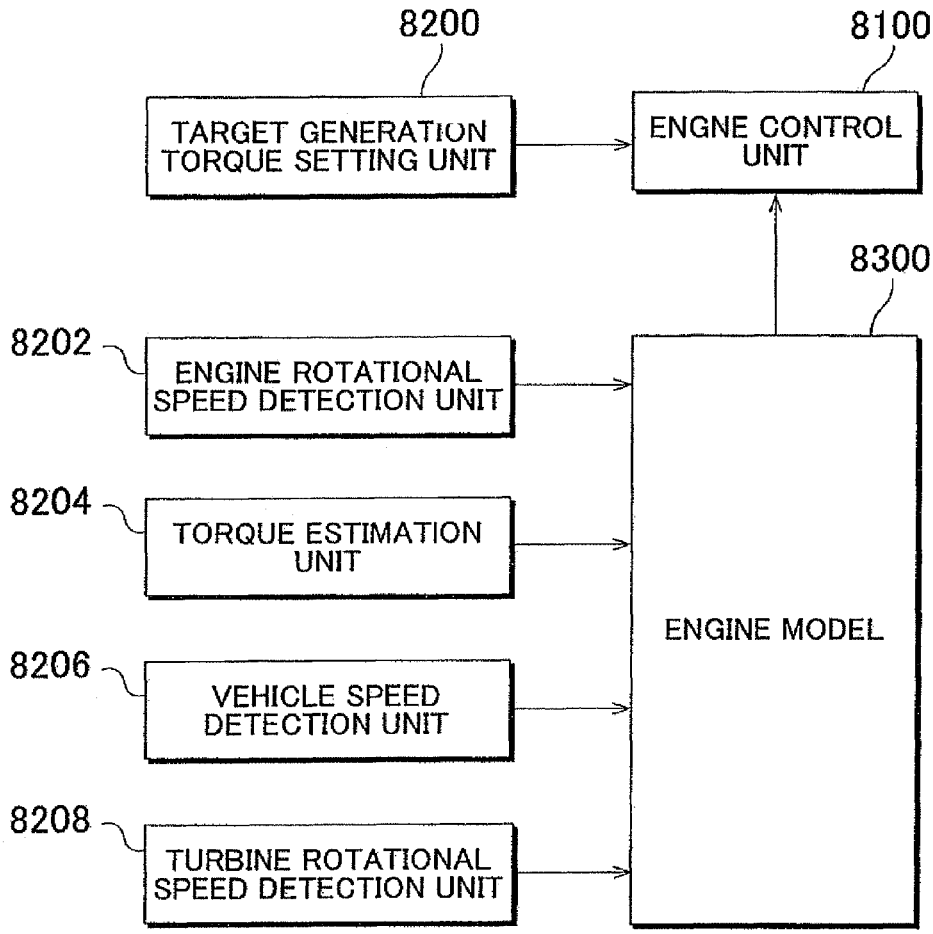
FIG. 5 is a functional block diagram of an ECU that controls the power train.

As shown in FIG. 5, the ECU 8000 includes an engine control unit 8100, a target generation torque setting unit 8200, an engine rotational speed detection unit 8202, a torque estimation unit 8204, a vehicle speed detection unit 8206, a turbine rotational speed detection unit 8208, and an engine model 8300.

The engine control unit 8100 controls devices provided for the engine 1000 on, the basis of a target generation torque and a target engine rotational speed so as to achieve the target generation torque. The target generation torque is a target value of a torque the engine 1000 generates. For example, the throttle valve 8016, an EGR valve (not shown), an injector, and the like, are controlled. The target engine rotational speed is, for example, used to obtain a load by which the target generation torque is achieved.

The target generation torque setting unit 8200 sets a target generation torque. For example, the target generation torque is set on the basis of a map, a function, and the like, that use the accelerator operation amount, the output shaft rotational speed NT of the automatic transmission 2000, a load due to the auxiliary machine 1004 driven by the engine 1000 as parameters.

The engine rotational speed detection unit 8202 detects an actual engine rotational speed NE on the basis of the signal transmitted from the engine rotational speed sensor 8020.

The torque estimation unit 8204 estimates an actual engine torque TE. When the engine 1000 is a gasoline engine, the actual engine torque TE is estimated on the basis of an intake air amount detected by the air flow meter 8012, an air fuel ratio, an ignition timing, and the like. When the engine 1000 is a diesel engine, the actual engine toque TE is estimated on the basis of a fuel injection amount. Note that a method of estimating the actual engine torque TE may employ a known typical technology and, therefore, the detailed description thereof will not be repeated.

The vehicle speed detection unit 8206 detects an actual vehicle speed. The actual vehicle speed is calculated on the basis of the output shaft rotational speed NO of the automatic transmission 2000. Note that a method of calculating the actual vehicle speed may employ a known typical technology, so the detailed description thereof will not be repeated.

The turbine rotational speed detection unit 8208 detects an actual turbine rotational speed NT on the basis of the signal transmitted from the input shaft rotational speed sensor 8022.

The engine model 8300 is a model (function) used to calculate (set) a target engine rotational speed from the target generation torque. The engine model 8300 excludes the influence of a delay of operation of the engine 1000, dead time, and resulting accuracy (difference between a target torque and an actual torque).

Figure 6:
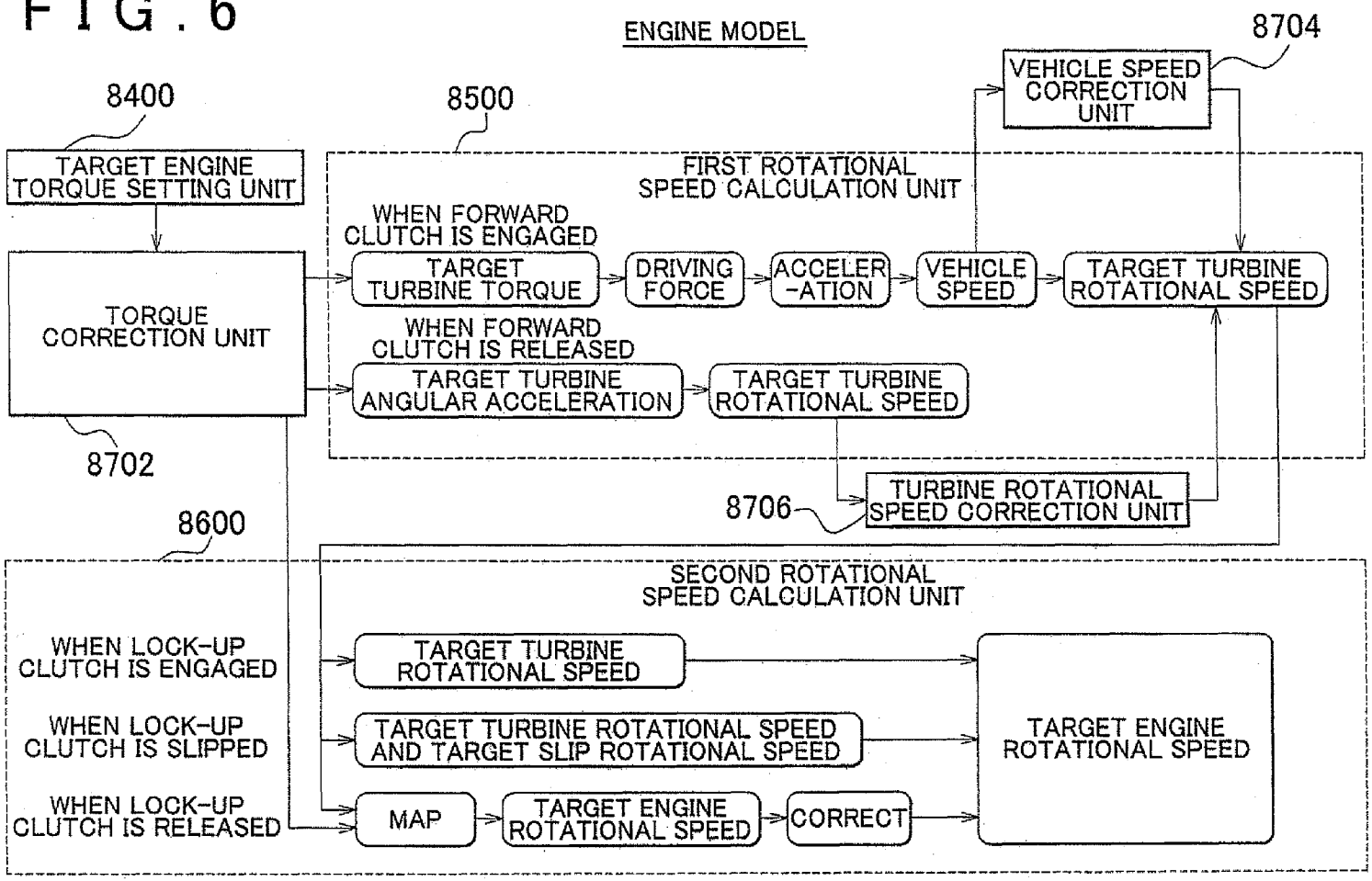
FIG. 6 is a view that shows a model of an engine that constitutes the power train.

As shown in FIG. 6, the engine model 8300 includes a target engine torque setting unit 8400, a first rotational speed calculation unit 8500, a second rotational speed calculation unit 8600, a torque correction unit 8702, a vehicle speed correction unit 8704, and a turbine rotational speed correction unit 8706.

The target engine torque setting unit 8400 subtracts a torque, caused by an inertia of the engine 1000, from the target generation torque to thereby set (calculate) a target engine torque. More specifically, a target engine torque is calculated by subtracting the product of an inertia of the engine 1000 and an angular acceleration of the target engine rotational speed from the target generation torque. The target engine rotational speed used to calculate a target engine torque is, for example, a previous value. The inertia is stored as data beforehand. The target engine torque is a torque transmitted from the engine 1000 to the torque converter 2100.

The first rotational speed calculation unit 8500 calculates (sets) a target turbine rotational speed of the torque converter on the basis of the target engine torque.

A method of calculating the target turbine rotational speed varies between when a forward clutch (C1 clutch 3301 in the first to fifth gears, and C2 clutch 3302 in the sixth to eighth gears) of the automatic transmission 2000 is engaged and when the forward clutch is released.

Hereinafter, a method of calculating the target turbine rotational speed when the forward clutch is engaged will be described.

When the D (drive) range is selected as the shift range, and the forward clutch is engaged, a target turbine torque of the torque converter is calculated on the basis of the target engine torque and the torque ratio of the torque converter. More specifically, a target turbine torque is calculated by subtracting the product of an inertia of a drive line and an angular acceleration of the target turbine rotational speed from the product of the target engine torque and the torque ratio of the torque converter. The drive line, including the automatic transmission 2000, is a structure that transmits a torque output from the engine 1000 to the rear wheels 7000.

The torque ratio is, for example, calculated in accordance with a map that defines a speed ratio (target turbine rotational speed/target engine rotational speed) and torque transmission characteristics (relationship between the torque ratio and the speed ratio, and the like) of the torque converter 2100. In addition, the target turbine rotational speed and the target engine rotational speed used to calculate a target turbine torque are, for example, previous values.

A target driving force of the vehicle is calculated on the basis of the target turbine torque. More specifically, the target turbine torque is multiplied by a current gear ratio of the automatic transmission 2000 and a gear ratio of the differential gear 6000 and then the result is divided by the radius of each rear wheel 7000 to thereby calculate a target driving force. The gear ratios of the automatic transmission 2000, the gear ratio of the differential gear 6000 and the radius of each rear wheel 7000 are stored as data beforehand.

A target acceleration of the vehicle is calculated on the basis of the target driving force. More specifically, the running resistance of the vehicle is subtracted from the target driving force and then the result is divided by the weight of the vehicle to thereby calculate a target acceleration. The running resistance and weight of the vehicle are stored as data beforehand. For example, the running resistance on level ground is used.

A target vehicle speed is calculated on the basis of the target acceleration. For example, a target vehicle speed is calculated by adding the current vehicle speed to a vehicle speed that is calculated by integrating the target acceleration.

A target turbine rotational speed is calculated on the basis of the target vehicle speed and the current gear ratio of the automatic transmission 2000. That is, a target turbine rotational speed is calculated backward from the target vehicle speed. More specifically, the target output shaft rotational speed of the automatic transmission 2000 is determined in one-to-one correspondence with the target vehicle speed, so the product of the target output shaft rotational speed and the gear ratio is calculated as the target turbine rotational speed.

Note that, during execution of neutral control that the forward clutch is slipped at a predetermined target slip ratio, a target turbine rotational speed is calculated in consideration of the target slip ratio. For example, a target turbine rotational speed is calculated so as to be reduced by a value corresponding to a target slip ratio as compared with the case in which the forward clutch is completely engaged.

Hereinafter, a method of calculating the target turbine rotational speed when the forward clutch is released will be described.

When the N (neutral) range is selected as the shift range, and the forward clutch is released, that is, when the automatic transmission 2000 is neutral, a target turbine angular acceleration of the torque converter is calculated on the basis of the target engine torque and the inertia of the drive line. Specifically, the target engine torque is divided by the inertia of the drive line to thereby calculate a target turbine angular acceleration. The inertia used to calculate a target turbine angular acceleration is an inertia of components located adjacent to the engine 1000 with respect to the forward clutch (particularly, C1 clutch 3301) in a torque transmission path. The inertia is stored as data beforehand.

A target turbine rotational speed is calculated on the basis of the target turbine angular acceleration. For example, a target turbine rotational speed is calculated by adding the current turbine rotational speed NT to a turbine rotational speed that is obtained by integrating the target turbine angular acceleration.

The second rotational speed calculation unit 8600 calculates (sets) a target engine rotational speed such that the target engine rotational speed varies in accordance with the target turbine rotational speed and the actual engine rotational speed NE in a steady state. The second rotational speed calculation unit 8600 calculates (sets) a target engine rotational speed such that the target engine rotational speed varies in accordance with the target turbine rotational speed independently of the actual engine rotational speed NE in a transient state in which the engine 1000 is unstable as compared with the steady state.

Whether the engine is in the steady state or in the transient state is, for example, determined in consideration of the rate of change in actual vehicle speed, the rate of change in oil temperature of the engine 1000, the rate of change in coolant temperature of the engine 1000, the rate of change in difference between a target value and an actually measured value, and the like.

Hereinafter, a method of calculating the target engine rotational speed using the target turbine rotational speed will be described. When a lock-up clutch of the torque converter 2100 is engaged, a target turbine rotational speed is calculated as the target engine rotational speed.

During execution of a slip control (it may also be called a flex lock-up control) that the lock-up clutch of the torque converter 2100 is slipped so that a difference in rotational speed between the engine rotational speed NE and the turbine rotational speed NT becomes a predetermined target slip rotational speed, a rotational speed that is greater by the target slip rotational speed than the target turbine rotational speed is calculated as the target engine rotational speed. Note that the slip control of the lock-up clutch is known as control that is executed during, for example, execution of fuel cut control.

When the lock-up clutch of the torque converter 2100 is released, a target engine rotational speed is calculated in accordance with a map that has the target engine torque and the target turbine rotational speed as parameters and that represents the transmission characteristics of the torque converter 2100. The map is prepared beforehand on the basis of test results of the torque converter 2100.

Figure 7:
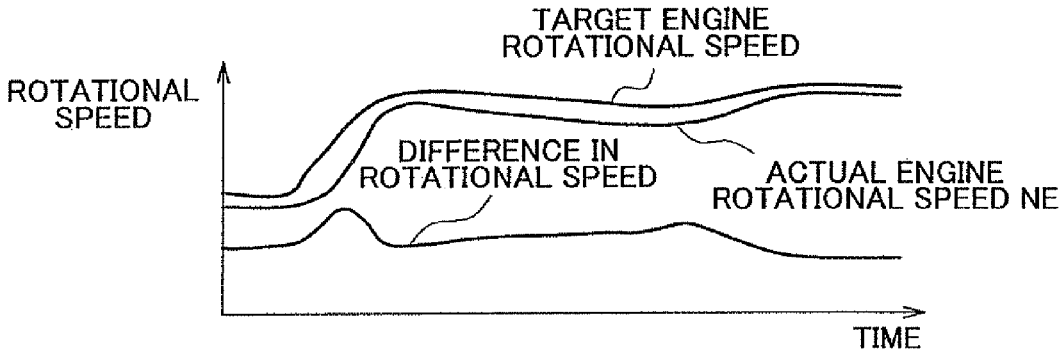
FIG. 7 is a first example of a graph that shows a target engine rotational speed and an actual engine rotational speed.

In the steady state, a difference between the actual engine rotational speed and the engine rotational speed, at which the target engine torque is achieved, is small. On the other hand, in the transient state, a difference between the actual engine rotational speed and the engine rotational speed, at which the target engine torque is achieved, is large. Thus, as shown in FIG. 7, the target engine rotational speed is calculated so that a difference from the actual engine rotational speed is small in the steady state and a difference from the actual engine rotational speed is large in the transient state.

However, the calculated target engine rotational speed may include an error. Then, the target engine rotational speed calculated in accordance with the map is corrected by adding a correction value. The correction value of the target engine rotational speed is set in accordance with the actual engine rotational speed NE when the lock-up clutch is released in the steady state.

The correction value is calculated (updated) by the following Expression 1. Note that in Expression 1, "ΔNET[i]" denotes a current correction value, "ΔNET[i−1]" denotes a previous correction value, "K" denotes a correction coefficient, "NE" denotes an actual engine rotational speed, and "NET" denotes a pre-corrected target engine rotational speed that is calculated in accordance with the map.

$$\Delta\mathrm{NET}[i]=\Delta\mathrm{NET}[i-1]+K(NE-\mathrm{NET}) \quad (1)$$

The correction value is set for each of a plurality of regions that are separated by engine rotational speed NE, actual engine torque (or load), and the like.

For example, when it continues for a predetermined period of time or more that the rate of change in actual vehicle speed is, smaller than a predetermined threshold and, in addition, the rate of change in oil temperature of the engine 1000 and the rate of change in coolant temperature of the engine 1000 are smaller than a predetermined threshold, it is determined to be the steady state and then the correction value is calculated by Expression 1. When the rate of change in actual, vehicle speed is larger than or equal to a predetermined threshold or when the rate of change in oil temperature of the engine 1000 and the rate of change in coolant temperature of the engine 1000 are larger than or equal to a predetermined threshold, it is determined to be the transient state and then calculation of the correction value is interrupted.

Figure 8:
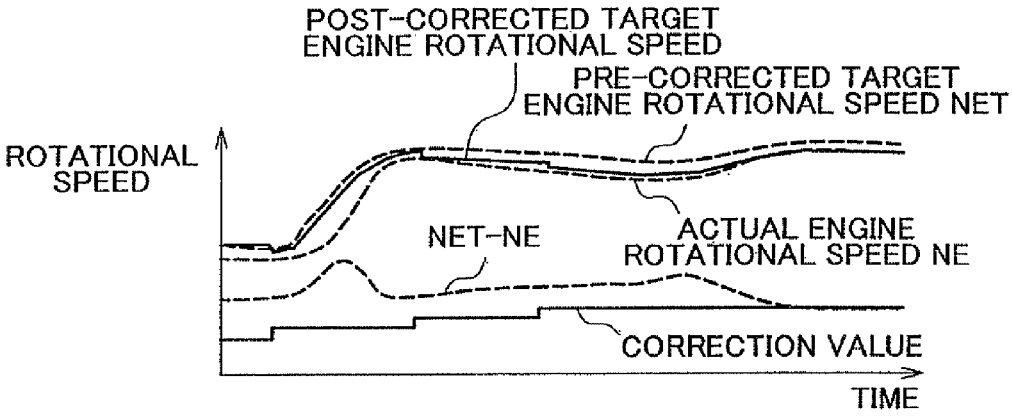
FIG. 8 is a second example of a graph that shows a target engine rotational speed and an actual engine rotational speed.

Thus, as shown in FIG. 8, in the steady state, the correction value is updated in accordance with the actual engine rotational speed NE. In the transient state, the correction value is maintained at constant. Thus, in the steady state, it is possible to obtain a target engine rotational speed that can vary in accordance with the actual engine rotational speed NE. In the transient state, it is possible to obtain a target engine rotational speed that can vary independently of the actual engine rotational speed NE.

By so doing, in the steady state in which a difference between the actual engine rotational speed and the engine rotational speed, at which the target engine torque is achieved, is small, as shown by the solid line in FIG. 8, it is possible to reduce an error when a target engine rotational speed is calculated. On the other hand, in the transient state in which a difference between the actual engine rotational speed and the engine rotational speed, at which the target engine torque is achieved, tends to be large, it is possible to control the engine 1000 using the target engine rotational speed that varies independently of the actual engine rotational speed. Thus, it is possible to control the engine 1000 using the target engine rotational speed that accurately corresponds to the engine rotational speed at which the target engine torque is achieved. As a result, the control accuracy of the engine may be improved.

The correction value of the target engine rotational speed may be updated using the following Expression 2 in place of Expression 1 and using only a difference, in the steady state, between the pre-corrected target engine rotational speed and the actual engine rotational speed NE.

$$\Delta\mathrm{NET}[i]=\int K(NE-\mathrm{NET})dt \quad (2)$$

The target engine rotational speed and the actual engine rotational speed NE in the steady state are extracted using a low-pass filter. The low-pass filter extracts only a difference between the pre-corrected target engine rotational speed and the actual engine rotational speed NE, of which the rates of change are smaller than a threshold. Thus, when the correction value is calculated by Expression 2, it is determined to be the steady state when the rate of change in difference between the pre-corrected target engine rotational speed and the actual engine rotational speed NE is smaller than a threshold, while it is determined to be the transient state when the rate of change in difference between the pre-corrected target engine rotational speed and the actual engine rotational speed NE is larger than or equal to a threshold.

The actual engine rotational speed NE in the transient state is, not used to calculate the correction value. Thus, in the steady state, it is possible to obtain a target engine rotational speed that can vary in accordance, with the actual engine rotational speed NE. In the transient state, it is possible to obtain a target engine rotational speed that can vary independently of the actual engine rotational speed NE.

Figure 9:
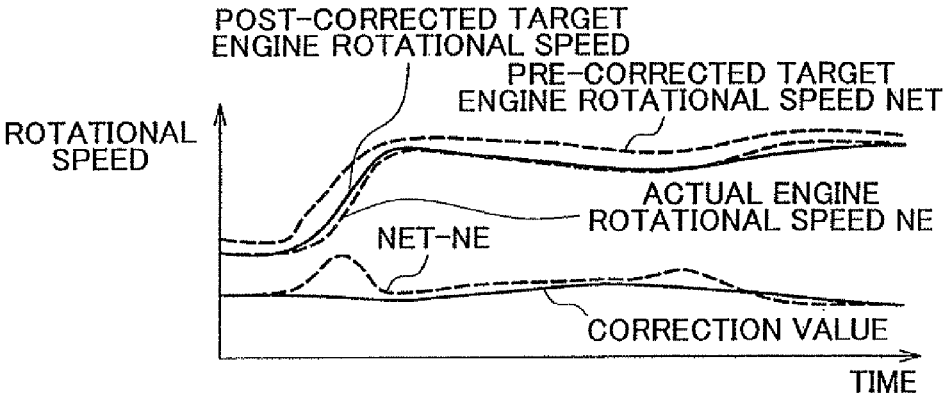
FIG. 9 is a third example of a graph that shows a target engine rotational speed and an actual engine rotational speed.

In this manner as well, as shown by the solid line in FIG. 9, it is possible to reduce a potential error in the steady state when a target engine rotational speed is calculated.

The torque correction unit 8702 corrects the target engine torque. A method of correcting the target engine torque is similar to the method of correcting the target engine rotational speed. That is, the target engine torque is corrected by adding a correction value that is calculated using the actual engine torque TE to the target engine torque. The correction value is calculated in the steady state by the following Expression 3 or Expression 4. Note that, in Expression 3 and Expression 4, "ΔTET[i]" denotes a current correction value, "ΔTET[i−1]" denotes a previous correction value, "K" denotes a correction coefficient, "TE" denotes an actual engine torque, and "TET" denotes a pre-corrected target engine torque.

$$\Delta TET[i]=\Delta TET[i-1]+K(TE-TET) \quad (3)$$

$$\Delta TET[i]=\int K(TE-TET)dt \quad (4)$$

When the correction value is calculated by Expression 4, a difference between the pre-corrected target engine torque and the actual engine torque TE, of which the rates of change are smaller than a threshold, is extracted by the low-pass filter as a difference, in the steady state, between the pre-corrected target engine torque and the actual engine torque TE. Thus, when the correction value is calculated by Expression 4, it is determined to be the steady state when the rate of change in difference between the pre-corrected target engine torque and the actual engine torque TE is smaller than a threshold, while it is determined to be the transient state when the rate of change in difference between the pre-corrected target engine torque and the actual engine torque TE is larger than or equal to a threshold.

The vehicle speed correction unit 8704 corrects the target vehicle speed. A method of correcting the target vehicle speed is similar to the method of correcting the target engine rotational speed. That is, the target vehicle speed is corrected by adding a correction value that is calculated using the actual vehicle speed to the target vehicle speed. The correction value is calculated in the steady state by the following Expression 5 or Expression 6. Note that, in Expression 5 and Expression 6, "ΔVT[i]" denotes a current correction value, "ΔVT[i−1]" denotes a previous correction value, "K" denotes a correction coefficient, "V" denotes an actual vehicle speed, and "VT" denotes a pre-corrected target vehicle speed.

$$\Delta VT[i]=\Delta VT[i-1]+K(V-VT) \quad (5)$$

$$\Delta VT[i]=\int K(V-VT)dt \quad (6)$$

When the correction value is calculated by Expression 6, a difference between the pre-corrected target vehicle speed and the actual vehicle speed, of which the rates of change are smaller than a threshold, is extracted by the low-pass filter as a difference, in the steady state, between the pre-corrected target vehicle speed and the actual vehicle speed. Thus, when the correction value is calculated by Expression 6, it is determined to be the steady state when the rate of change in difference between the pre-corrected target vehicle speed and the actual vehicle speed is smaller than a threshold, while it is determined to be the transient state when the rate of change in difference between the pre-corrected target vehicle speed and the actual vehicle speed is larger than or equal to a threshold.

The target vehicle speed is corrected to thereby correct running resistance, the inertia and transmission efficiency of the drive line, and the like.

The turbine rotational speed correction unit 8706 corrects the target turbine rotational speed. A method of correcting the target turbine rotational speed is similar to the method of correcting the target engine rotational speed. That is, the target turbine rotational speed is corrected by adding a correction value that is calculated using the actual turbine rotational speed NT to the target turbine rotational speed. The correction value is calculated in the steady state by the following Expression 7 or Expression 8. Note that, in Expression 7 and Expression 8, "ΔNTT[i]" denotes a current correction value, "ΔNTT[i−1]" denotes a previous correction value, "K" denotes a correction coefficient, "NT" denotes an actual turbine rotational speed, and "NTT" denotes a pre-corrected target turbine rotational speed.

$$\Delta NTT[i]=\Delta NTT[i-1]+K(NT-NTT) \quad (7)$$

$$\Delta NTT[i]=\int K(NT-NTT)dt \quad (8)$$

When the correction value is calculated by Expression 8, a difference between the pre-corrected target turbine rotational speed and the actual turbine rotational speed NT, of which the rates of change are smaller than a threshold, is extracted by the low-pass filter as a difference, in the steady state, between the pre-corrected target turbine rotational speed and the actual turbine rotational speed NT. Thus, when the correction value is calculated by Expression 8, it is determined to be the steady state when the rate of change in difference between the pre-corrected target turbine rotational speed and the actual turbine rotational speed NT is smaller than a threshold, while it is determined to be the transient state when the rate of change in difference between the pre-corrected target turbine rotational speed and the actual turbine rotational speed NT is larger than or equal to a threshold.

As described above, according to the controller of the present embodiment, a target engine rotational speed is calculated so that the target engine rotational speed varies in accordance with the target engine torque and the actual engine rotational speed in the steady state. On the other hand, in the transient state in which, because of an unstable engine, a difference between the actual engine rotational speed, detected at the time when the target engine torque is set, and the engine rotational speed, at which the target engine torque is achieved, can be large, a target engine rotational speed is calculated so that the target engine rotational speed varies in accordance with a target engine torque independently of the actual engine rotational speed. The engine is controlled using the calculated target engine rotational speed. In this manner, in the steady state in which a difference between the actual engine rotational speed and the engine rotational speed, at which the target engine torque is achieved, it is possible to control, the engine using the target engine rotational speed having a small error. In the transient state in which a difference between an actual engine rotational speed and an engine rotational speed, at which a target engine torque is achieved, is large, it is possible to control the engine using the target engine rotational speed that varies only in accordance with the target engine torque independently of the actual engine rotational speed. Thus, it is possible to control the engine using the target engine rotational speed that accurately corresponds to the engine rotational speed, at which the target engine torque is achieved. As a result, the control accuracy of the engine may be improved.

The embodiment described above is illustrative and not restrictive in all respects. The scope of the invention is defined by the appended claims rather than the above description. The scope of the invention is intended to encompass all modifications within the scope of the appended claims and equivalents thereof.

The invention claimed is:

1. A controller for an engine that is mounted on a vehicle, comprising:

a target engine torque setting unit that sets a target engine torque;

an actual engine rotational speed detection unit that detects an actual engine rotational speed;

a calculation unit that calculates a target engine rotational speed such that the target engine rotational speed varies in accordance with the target engine torque and the actual engine rotational speed in a first operational state, and that calculates the target engine rotational speed such that the target engine rotational speed varies in according with the target engine torque independently of the actual engine rotational speed in a second operational state in which the engine is unstable as compared with the first operational state; and a control unit that controls the engine using the target engine rotational speed;

wherein:

the engine is coupled through a torque converter to a transmission, the controller further comprises a first rotational speed calculation unit that calculates a target turbine rotational speed of the torque converter on the basis of the target engine torque, the calculation unit includes a second rotational speed calculation unit that calculates the target engine rotational speed such that the target engine rotational speed varies in accordance with the target turbine rotational speed and the actual engine rotational speed in the first operational state, and that calculates the target engine rotational speed such that the target engine rotational speed varies in accordance with the target turbine rotational speed independently of the actual engine rotational speed in the second operational state, and the control unit adjusts the actual engine rotational speed towards the target engine rotational speed.

2. The controller according to claim 1, wherein the first rotational speed calculation unit includes:

a turbine torque calculation unit that calculates a target turbine torque of the torque converter on the basis of the target engine torque and a torque ratio of the torque converter;

a target driving force calculation unit that calculates a target driving force of the vehicle on the basis of the target turbine torque;

a target acceleration calculation unit that calculates a target acceleration of the vehicle on the basis of the target driving force;

a target vehicle speed calculation unit that calculates a target vehicle speed on the basis of the target acceleration; and a target turbine rotational speed calculation unit that calculates the target turbine rotational speed on the basis of the target vehicle speed and a gear ratio of the transmission.

3. The controller according to claim 2, wherein the turbine torque calculation unit calculates the target turbine torque by subtracting a torque, caused by an inertia of the transmission, from the product of the target engine torque and a torque ratio of the torque converter.

4. The controller according to claim 2, further comprising:

an actual vehicle speed detection unit that detects an actual vehicle speed; and a target vehicle speed correction value setting unit that sets a correction value, by which the target vehicle speed is corrected, in accordance with the actual vehicle speed in the first operational state.

5. The controller according to claim 1, wherein the first rotational speed calculation unit calculates a target turbine angular acceleration of the torque converter on the basis of the target engine torque and an inertia of the transmission, and the first rotational speed calculation unit calculates a target turbine rotational speed of the torque converter on the basis of the target turbine angular acceleration.

6. The controller according to claim 5, further comprising:

an actual turbine rotational speed detection unit that detects an actual turbine rotational speed; and a target turbine rotational speed correction value setting unit that sets a correction value, by which the target turbine rotational speed is corrected, in accordance with the actual turbine rotational speed in the first operational state.

7. The controller according to claim 1, wherein the second rotational speed calculation unit includes:

an engine rotational speed calculation unit that calculates the target engine rotational speed on the basis of the target turbine rotational speed; and a target engine rotational speed correction value setting unit that sets a correction value, by which the target engine rotational speed is corrected, in accordance with the actual engine rotational speed in the first operational state.

8. The controller according to claim 7, wherein the engine rotational speed calculation unit calculates the target engine rotational speed in accordance with a map that has the target engine torque and the target turbine rotational speed as parameters.

9. The controller according to claim 7, wherein the torque converter is provided with a lock-up clutch, the engine rotational speed calculation unit calculates the target engine rotational speed in accordance with a map that has the target engine torque and the target turbine rotational speed as parameters when the lock-up clutch is released, the engine rotational speed calculation unit calculates the target turbine rotational speed as the target engine rotational speed when the lock-up clutch is engaged, the engine rotational speed calculation unit calculates a rotational speed that is greater by a predetermined value than the target turbine rotational speed as the target engine rotational speed when the lock-up clutch is slipped, and the target engine rotational speed correction value setting unit sets a correction value, by which the target engine rotational speed calculated in accordance with the map is corrected, in accordance with the actual engine rotational speed when the lock-up clutch is released in the first operational state.

10. The controller according to claim 1, wherein the target engine torque is obtained by subtracting a torque, caused by an inertia of the engine, from a target torque that the engine generates.

11. The controller according to claim 1, further comprising:

an actual engine torque detection unit that detects an actual engine torque; and a target engine torque correction value setting unit that sets a correction value, by which the target engine torque is corrected, in accordance with the actual engine torque in the first operational state.

* * * * *